US006736311B2

(12) United States Patent
Hägglund et al.

(10) Patent No.: US 6,736,311 B2
(45) **Date of Patent: *May 18, 2004**

(54) APPARATUS FOR HANDLING BANKNOTES

(76) Inventors: Ruben Hägglund, S-579 00, Högsby (SE); Ragnar Berg, S-125 55, Älvsjö (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 37 days.

(21) Appl. No.: 10/104,734

(22) Filed: Mar. 22, 2002

(65) Prior Publication Data

US 2002/0170955 A1 Nov. 21, 2002

Related U.S. Application Data

(63) Continuation of application No. PCT/SE00/02023, filed on Oct. 19, 2000.

(30) Foreign Application Priority Data

Nov. 4, 1999 (SE) ..... 9904006

(51) Int. Cl.[7] ..... G07G 1/00
(52) U.S. Cl. ..... 235/10; 235/7 R
(58) Field of Search ..... 235/379, 475, 235/7 R, 10

(56) References Cited

U.S. PATENT DOCUMENTS 5,173,590 A * 12/1992 Nakano et al. ..... 235/379
5,186,334 A * 2/1993 Fukudome et al. ..... 209/534
5,719,383 A * 2/1998 Forrest ..... 235/379
6,145,737 A * 11/2000 Imai et al. ..... 232/1 D
6,510,985 B1 * 1/2003 Clark et al. ..... 235/379

FOREIGN PATENT DOCUMENTS

JP 354111400 A * 8/1979

* cited by examiner

*Primary Examiner*—Karl D. Frech
(74) *Attorney, Agent, or Firm*—Michael Best & Friedrich LLP

(57) ABSTRACT

The invention refers to a bank note handling apparatus comprising an input device with an integrated detector or bank note reader (8), such as a scanner, and a motor for inputting and outputting bank notes, a bank note seizing and conveying device (9) for delivering or removing bank notes in compartments corresponding to the bank note denominations in a bank note box (11), and a removable cover (40) for the bank note box (11), said cover (40) being automatically locked to the bank note box by means of a lock (39) built into the latter when the cover (40) is slid to its end position on the bank note box (11). A key (36) fitting said lock (39) is built into the bank note handling apparatus and can automatically be turned by means of a computer controlled motor for locking the bank note box (11) but cannot be removed from the bank note handling apparatus. The bank note box (11) can be unlocked only with a key (71) which is stored externally to the bank note handling apparatus under secure circumstances.

13 Claims, 13 Drawing Sheets

APPARATUS FOR HANDLING BANKNOTES

This is a continuation of PCT application PCT/SE00/02023 filed Oct. 19, 2000, which, in turn claimed priority of Swedish application 9904006-5 filed Nov. 4, 1999.

TECHNICAL FIELD

The present invention concerns bank note handling apparatus for use for example by a cashier in a supermarket. More specifically the invention concerns bank note handling apparatus which includes a bank note box which is inaccessible in operation and which is covered by a cover and is locked prior to being removed from its operating position so that it becomes impossible for an unauthorized person to open the bank note box when it has been removed from its position in the bank note handling apparatus. The bank note box can be unlocked with a key which is securely retained, for example in a safe in the office of the supermarket. The bank note box can to advantage be subdivided into a number of compartments corresponding to the number of possible bank note denominations and can be used in cooperation with a cash register.

STATE OF THE ART

Bank note handling apparatuses according to the state of the art are complicated and despite this their contents may be easily accessible if the cashier is subjected to a threat or a hold-up. Furthermore, bank note handling apparatuses according to the state of the art are often space consuming and unwieldy to work with. In the conventional case it may also be necessary to handle the bank notes twice if a security box which is used for reducing the volume and the value of bank notes which are retained in the cash box itself is utilized.

The closest known prior art is U.S. Pat. No. 5,695,038 which shows a drop safe for receiving and temporarily storing currency from a cash register. An entry device, such as a keypad, allows designated persons, such as cashiers or store managers, to deposit currency in the safe but not the general public. Deposits in the drop safe can be accepted in a number of acceptors that replace each other when a currency-receiving cassette in each individual acceptor is filled with bank notes. The cassettes are periodically removed from the drop safe by an armored-car driver or other authorized service person and replaced with empty cassettes. Bank notes in the cassettes have mixed denominations and there are no individual compartments for one single bank note denomination in each.

As further prior art the following patent specifications may be mentioned: U.S. Pat. No. 4,786,785, FR 2618993, U.S. Pat. No. 5,813,510, U.S. Pat. No. 5,427,036 and U.S. Pat. No. 5,615,759, respectively.

BRIEF DESCRIPTION OF THE DRAWINGS

FIGS. 1–3 are schematics showing a bank note moving through a preferred embodiment of a bank note handling apparatus according to the present invention;

FIG. 5 including

FIGS. 9–11 are rear perspective views of the interior of a preferred embodiment of a bank note handling apparatus according to the present invention illustrating a bank note moving through the apparatus;

DESCRIPTION OF THE INVENTION

Figure 7:
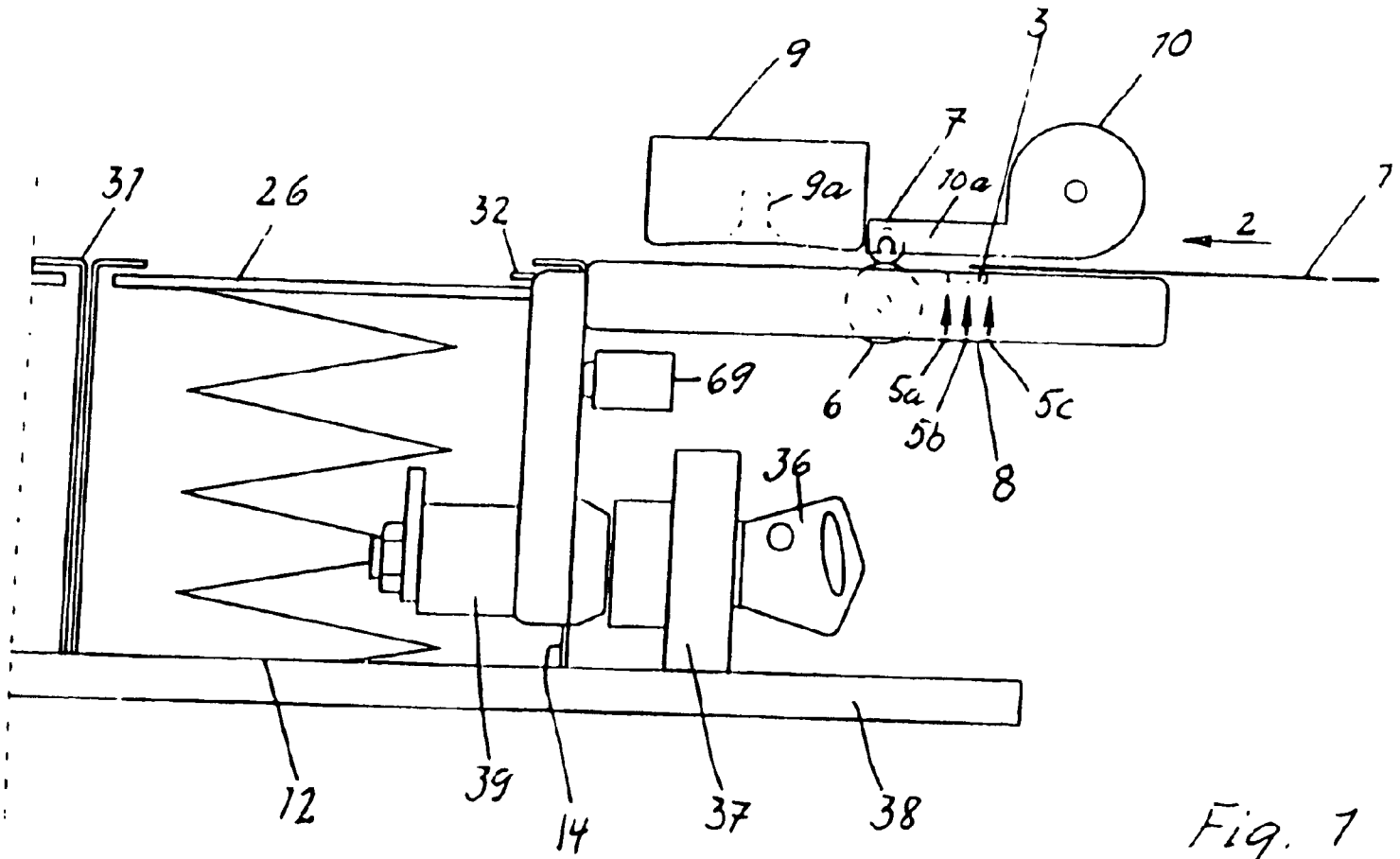
FIG. 7 is a rear perspective view of the interior of a preferred embodiment of a bank note handling apparatus according to the present invention.

The bank note handling apparatus of the invention is small in size and is very easy to work with. Its purpose is to ensure that the cashier has his or her cash flow entirely safe and that the cash flow is not accessible to either the cashier or anyone else during the period when it is located in the bank note handling apparatus or when it is being removed from the bank note handling apparatus and conveyed for example to a safe. In this manner it is possible for instance to avoid keeping bank notes in a cash register overnight. The bank note handling apparatus of the invention provides a solution for automatic bank note handling which is utilized without the bank notes being exposed on their way from the bank note handling apparatus to an office or a bank.

It is easy to handle the bank note box in the bank note handling apparatus and said box comprises a secure place to keep bank notes, the total amount of which always can be known in consequence of each deposit and removal of bank notes (and coins) during a workshift being recorded in a computer. The bank note box replaces a traditional cash box whose contents of bank notes normally is exposed in each payment transaction between a customer and a cashier and concerning which each cashier must maintain and be responsible for his or her cash flow results in a workshift.

Contrary to traditional cash registers the bank note handling apparatus in accordance with the invention can be activated by either the customer or the cashier. The apparatus utilizes computer controlled motorized input and output of bank notes. The entire procedure of automatic bank note handling is carried out by the computer of the apparatus which controls all functions but also has the capacity of independently handling the entire need of cash flow routines such as registering and storing and can be upgraded for all possible requirements and needs. The computer can also be utilized for providing information to the customer on a display concerning the bank note denomination which at the moment is best needed, furthermore for keeping track of denominations for payment and for ensuring that the contents of the bank note box are appropriate prior to the time drawing close to shifting bank note boxes at the respective checkout counters.

The computer is programmed in such manner that with the assistance of a bank note reader for input it ensures that in-flowing functions in the bank note handling apparatus are carried out in secure and reliable manner and that the difference between the amount of purchase which has been keyed in by the cashier and the amount that has been paid is returned in appropriate bank note denominations.

Naturally the cashier also should be able to pay back the customer a desired amount manually by means of a keypad, said amount also being recorded in the computer.

The bank note handling apparatus of the invention comprises an input device with an integrated detector or bank note reader, such as a scanner, and a motor for input and output, respectively, of bank notes, a seizing and conveying device, for example a vacuum suction block, whose purpose is to deposit bank notes in compartments in a bank note box corresponding to the bank note denomination and to remove bank notes from compartments in the bank note box corresponding to the bank note denomination, respectively, and a removable cover for the bank note box, said cover being, by means of a lock which is built into the bank note box, automatically locked on the bank note box when the cover is fully slid onto the bank note box. A key that cooperates with said lock or a corresponding lock actuating device is built into the bank note handling apparatus and can automatically be turned by a computer controlled motor for locking the bank note box but cannot be removed from the bank note handling apparatus.

At least two keys are allotted to each bank note handling apparatus. One of these keys is unremovably positioned in the bank note handling apparatus which is mounted in the checkout counter whereas the other one is issued to a responsible person for example in the office or in a bank. The person that works at the checkout counter can remove a bank note box from the bank note handling apparatus by logging out. However, before the bank note box can be removed the relevant person has to slide the cover onto the bank note box in the bank note handling apparatus. In his or her doing so, two automatic functions are activated for example by means of a microswitch, viz. on the one hand the cover is securely locked onto the bank note box and on the other hand the bank note box is released from the bank note handling apparatus so that it can be turned over to the office. The responsible person in the office can unlock and remove the cover by means of his or her key which fits into the lock in the respective bank note boxes and can take out the contents of bank notes and thereafter supply the empty bank note box with a small number of bank notes primarily being of smaller denominations (initial amount of money for the next workshift) and thereupon lock the cover. The bank note box will thereby be prepared for being delivered back to the checkout counter with the cover locked on it for the next workshift. The cover will be automatically unlocked so that it can be removed when the bank note box is introduced into a predetermined position in the bank note handling apparatus.

In clarification of the above it should be mentioned that in order for each cashier to be responsible for the revenue received during the relevant workshift the cashier logs into a computer which keeps track of the input and output of bank notes during said cashier's workshift. When the cashier logs out at the end of the workshift the computer knows the exact denominations and the exact number of bank notes that have been supplied to the bank note box and removed from it during the shift. By knowing how many bank notes were in the bank note box initially it is possible to know exactly how many bank notes and which denominations the bank note box contains at the end of the workshift. Several cashiers can log out and log in, respectively, during the same workshift, which can be done without changing the bank note box, as the computer keeps track of the cash flow activities that occur. It is most appropriate to have one or more bank note boxes associated with a specific checkout counter.

Secure handling of the bank notes is enabled and controlling the cash flow of the workshift is facilitated by each customer, if necessary with the assistance of the cashier, introducing the bank notes that the relevant customer is to pay with into a slit in a detector, for example in the form of a bank note reader, which may be a scanner, which checks the denomination and authenticity of the bank notes. This can be done by checking for example the color of the bank note, its pattern, its size, and its paper structure, respectively. It may be possible to utilize spectral analysis for one or more of these checkups. A report concerning the results can be provided to an analysis program in a computer which also senses when the bank note reaches a predetermined input and output position, respectively, in the bank note reader.

If the authenticity is approved each consecutive bank note is seized by the above-mentioned seizing and conveying device, for example a vacuum suction block, and is conveyed inside of the enclosed casing of the bank note handling apparatus which surrounds the bank note box to a position over a compartment in the bank note box corresponding to the denomination of the bank note. The seizing and conveying device, which here is assumed to be the above-mentioned vacuum suction block, is then lowered into the relevant compartment in the bank note box and thereafter carries out a return movement with disconnected vacuum so that the bank note can be restrained in the compartment, for example by the longitudinal edges of the bank note being caught by extending portions of the longitudinal edges of the bank note compartment when a plate supporting all the bank notes in the compartment is urged upwards by a spring located under said plate.

When conversely a bank note with a specific denomination is to be furnished to the customer as return payment the cashier completes the purchase by pressing a specific key in the keypad, whereby a computer initiates output from the corresponding bank note compartment by the vacuum suction block being lowered into the compartment, attaching the uppermost bank note by suction, and lifting it to the position for lateral conveyance, with only one single bank note being drawn out of the compartment whereas the remainder are prevented from this by the above-mentioned extending portions of the longitudinal edges of the bank note compartment. The vacuum suction block is then conveyed to the position for feeding out the bank note through the same slit in the bank note reader through which it was introduced, and the bank note is output through said slit after the bank note reader has checked the authenticity and denomination of the bank note and has established that they are in agreement with the markings provided in the computer and has checked the feed-out position of the bank note. Coins are handled in a conventional coin handling apparatus.

All operations are recorded in the computer, and the person who has logged in and logged out is responsible for all operations that are performed. All operations are recorded with information on the time of day and the date in the computer and it is possible to read out what has occurred exactly as with a cash register slip.

As a safety measure the interior of the bank note box can be provided with one or more ink vials, for example one in each compartment, which break open if an unauthorized person seizes the bank note box, for example when it is being conveyed between the cash register and the supermarket safe, and forces the cover open, with the ink vials coloring the bank notes whereby the latter lose their value.

The ink vials can for example be activated by a chip which is disposed in the bank note box. This activation may be carried out by means of a signal of a specific frequency from a transmitter which is positioned in an appropriate place where a thief may be expected to exit the supermarket.

Substantial advantages of the bank note handling apparatus of the invention are that in addition to its operation with complete security it operates at high speed and is basically self-handling, whereby the cashier can begin with a new customer without unnecessary delay. Additional important advantages of the bank note handling apparatus of the invention are that it keeps the bank notes entirely secure and can be manufactured at very competitive cost.

The means by which the above is achieved are disclosed in the accompanying claims.

Figure 3:
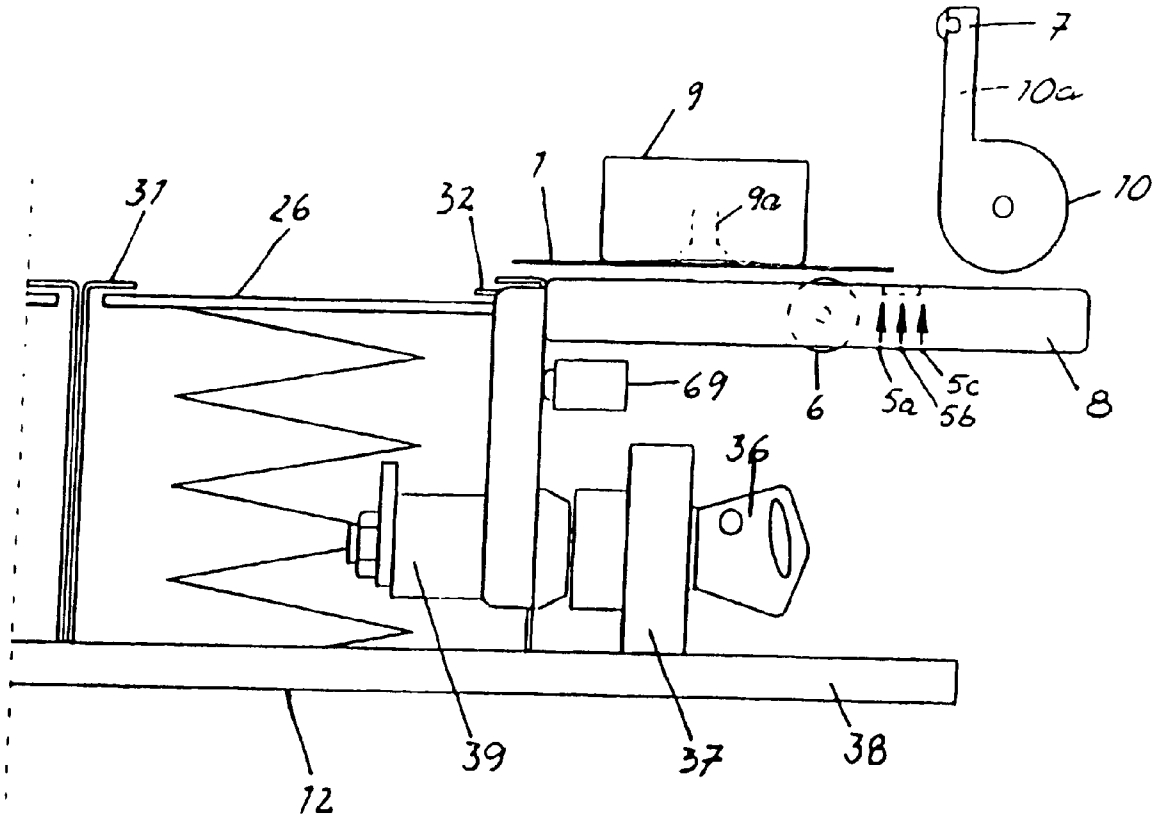
Figures 4, 5A, 5B, 5C:
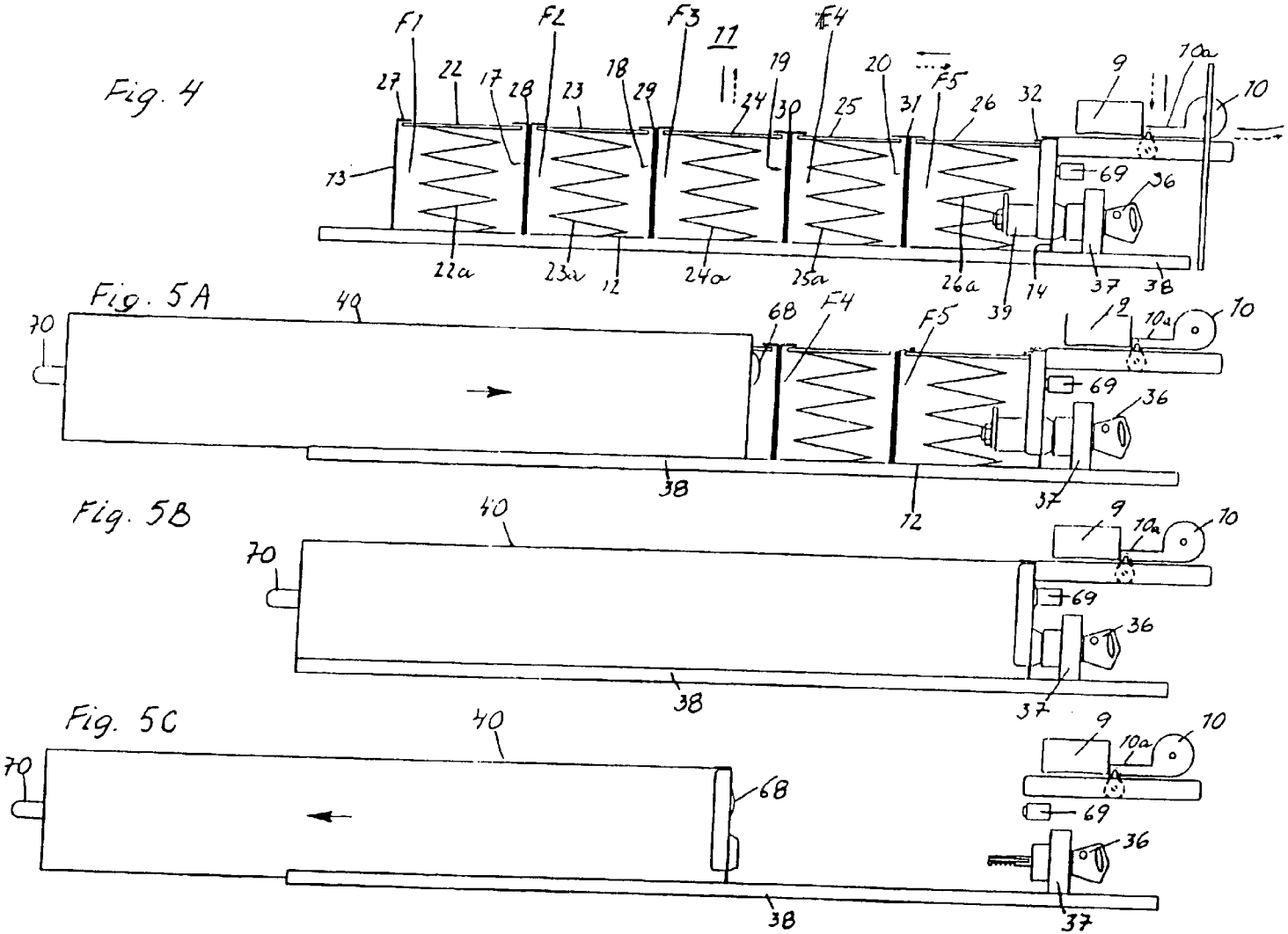
FIG. 4 is a side view of a preferred embodiment of a bank note handling apparatus according to the present invention.
FIGS. 5A, 5B, and 5C, are side views of a preferred embodiment of a bank note handling apparatus according to the present invention illustrating the covering and removal of a bank note box.
Figure 6:
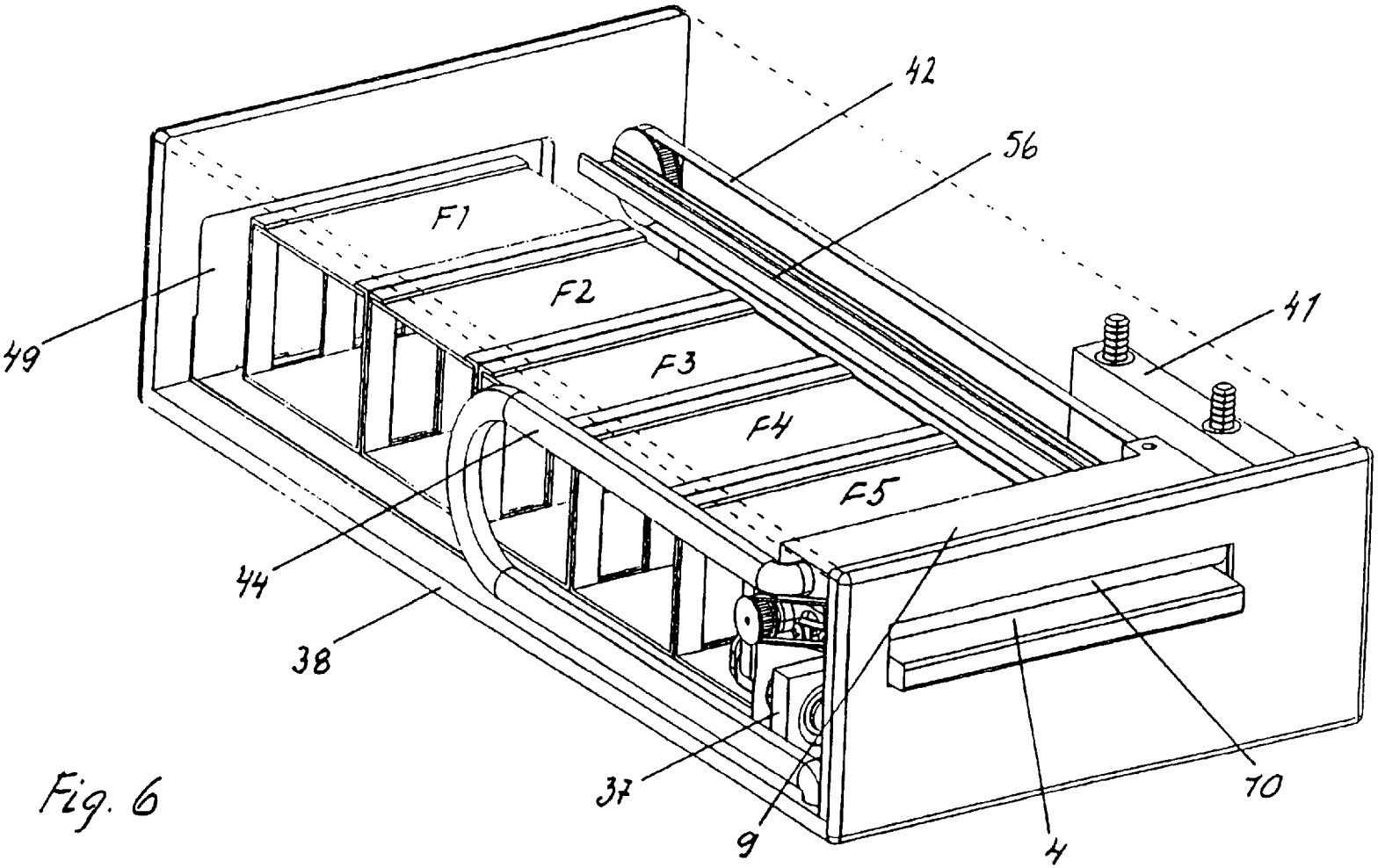
FIG. 6 is a front perspective view of the interior of a preferred embodiment of a bank note handling apparatus according to the present invention.
Figure 7:
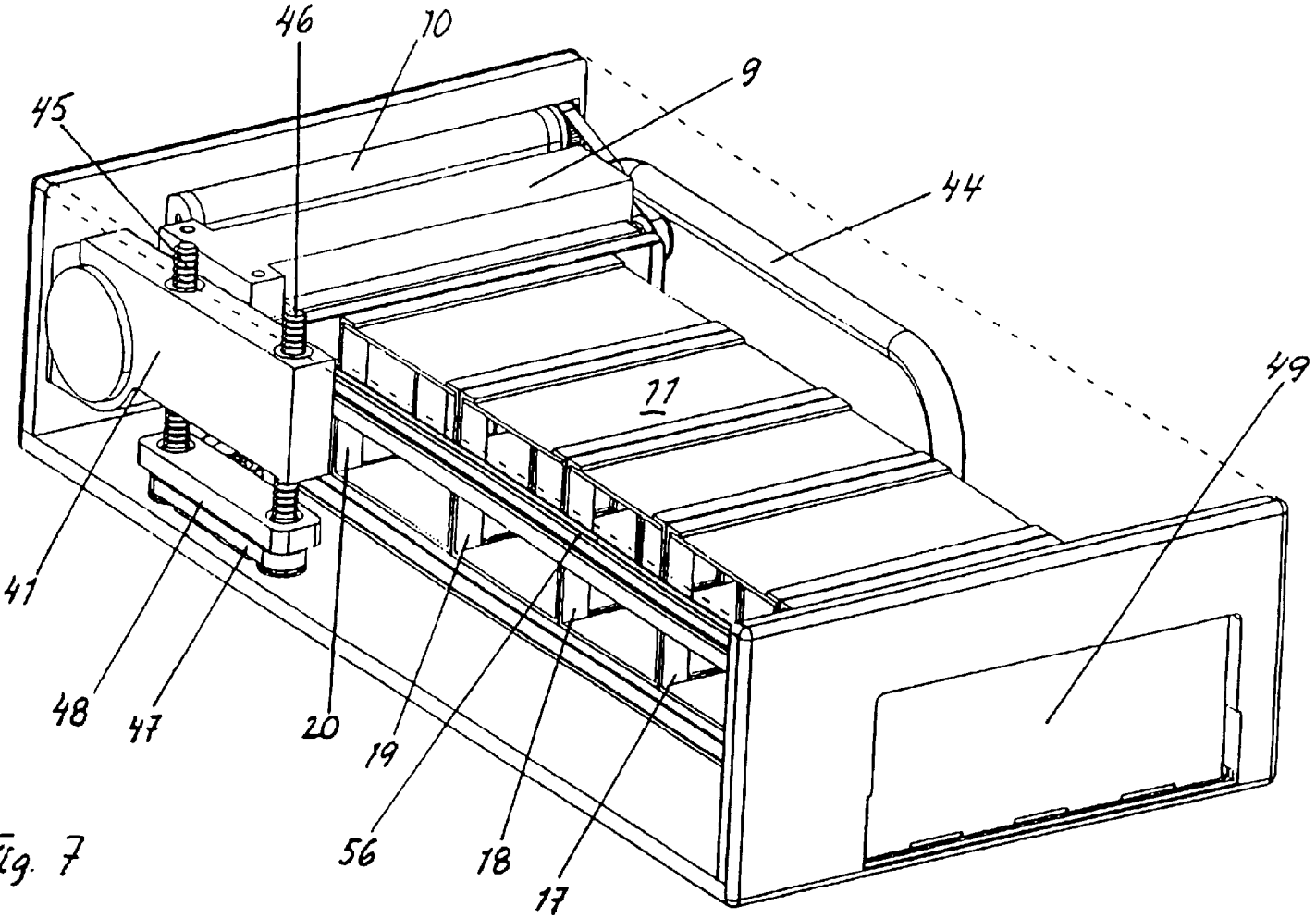
Figure 13:
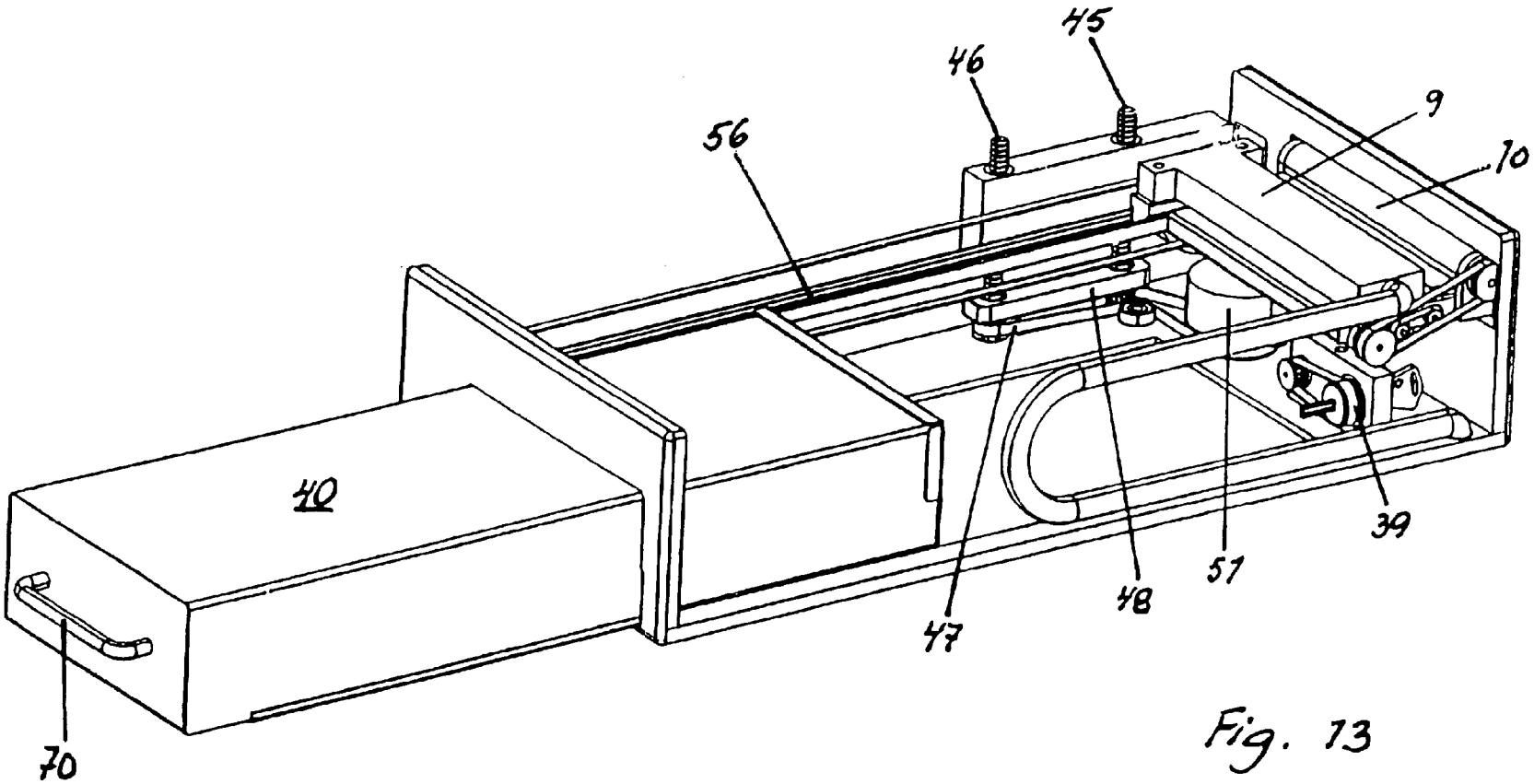
FIG. 13 is a rear perspective view of a preferred embodiment of a bank note handling apparatus according to the present invention illustrating the removal of the covered bank note box.
Figure 14:
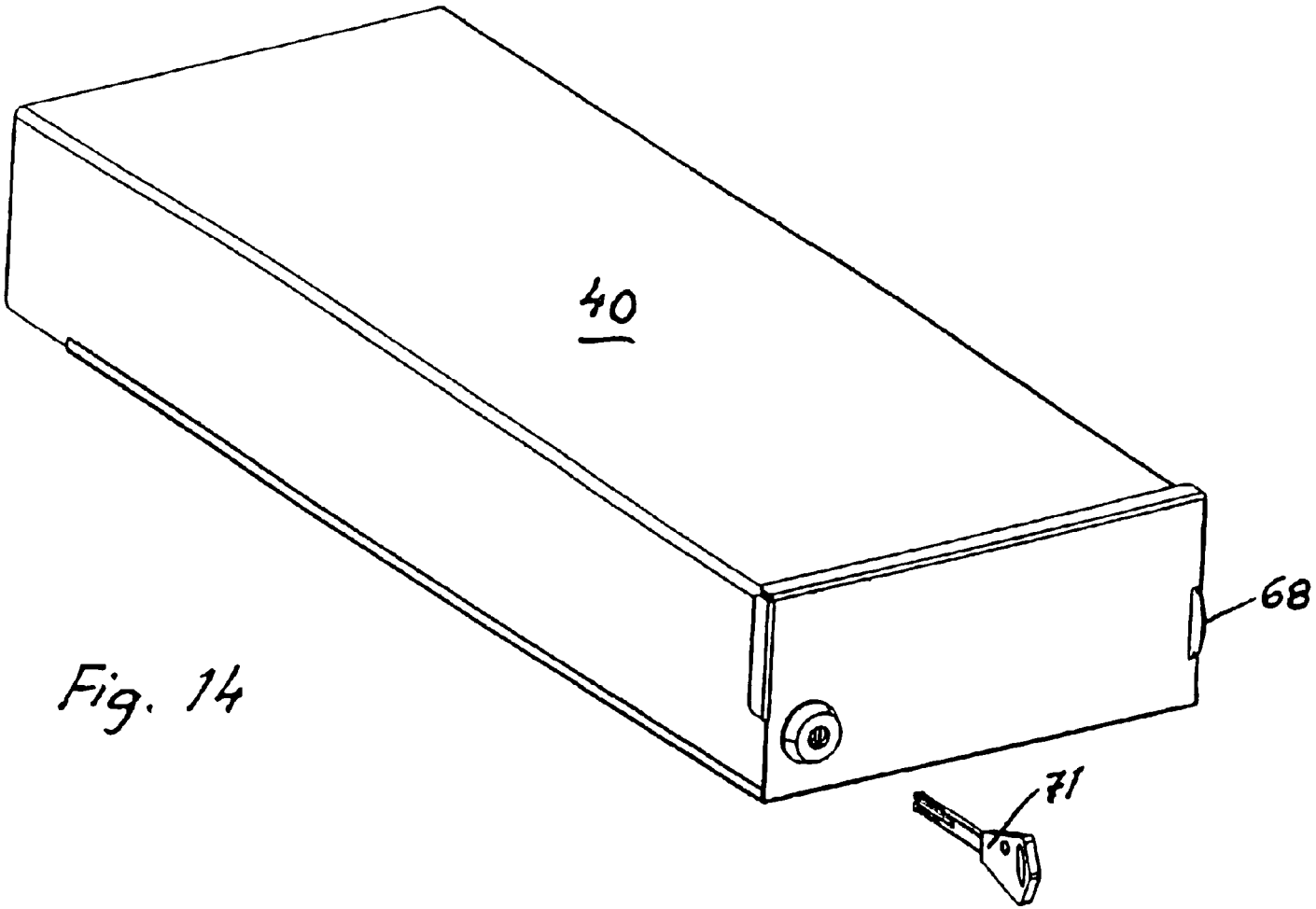
FIG. 14 is a front perspective view of a preferred embodiment of a bank note box according to the present invenion.

The invention will be described more specifically in the following with reference to the accompanying drawings, in which FIGS. 1, 2, and 3, respectively, schematically show the principle of feeding a bank note into the bank note handling apparatus of the invention, FIG. 4 schematically shows the principle of conveying a bank note to a bank note box, FIGS. 5A, 5B, and 5C, respectively, show how a lockable cover can be slid onto the bank note box, FIG. 6 is a perspective view of the interior of the bank note handling apparatus in accordance with the invention, FIG. 7 is a perspective view corresponding to FIG. 6 but taken from the diagonally opposite direction, FIGS. 8, 9, 10, 11, 12, and 13, respectively, are perspective views of the interior of the bank note handling apparatus viewed from different directions, and FIG. 14 is a perspective view of the bank note box with the cover fully slid on.

Figure 2:
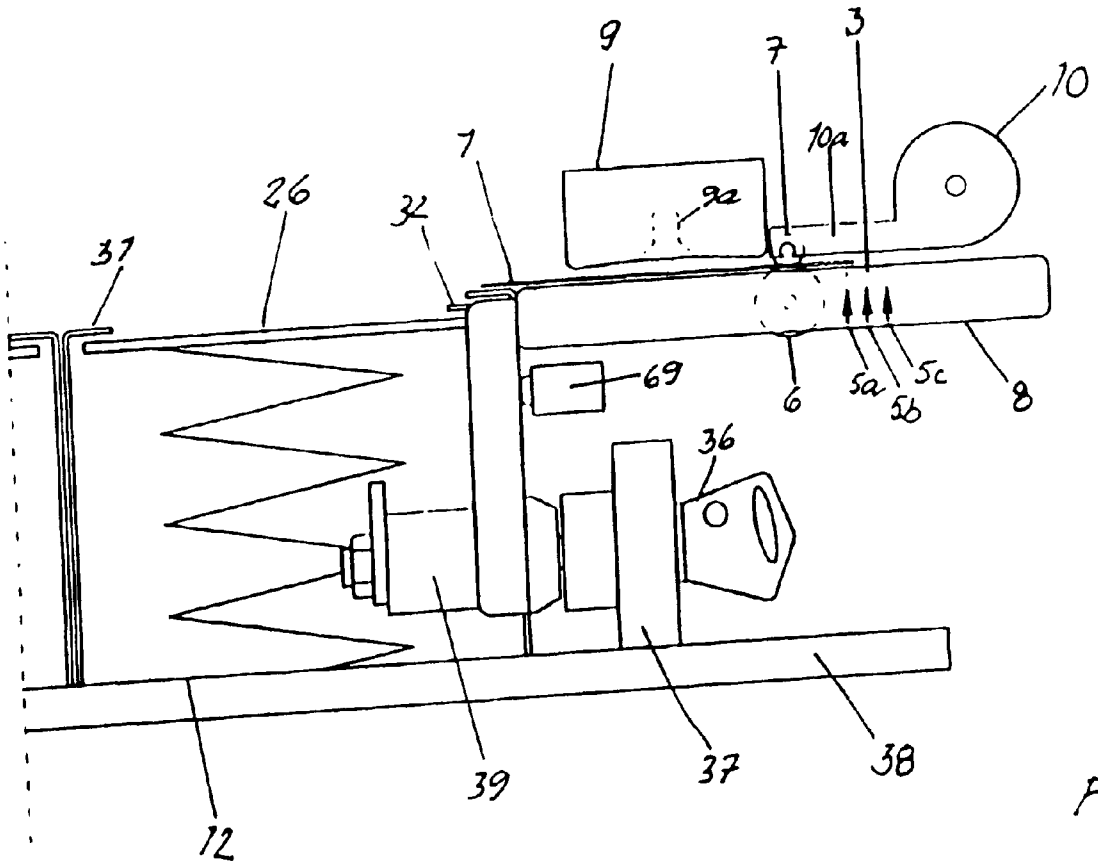

FIGS. 1, 2, and 3, respectively, schematically show the principle of feeding a bank note into the bank note handling apparatus in accordance with the invention. More specifically, FIG. 1 shows a bank note 1 which is slid in a direction 2 by a customer or a cashier in a supermarket. The bank note can appropriately be slid sidewise but is not limited to this. The front portion of the bank note is shown outside a transverse slit 3 in a bank note reader 8 in which characteristic features of the bank note are read. This is marked out by arrows 5*a*, 5*b*, and 5*c*, respectively. These features may for example be the denomination of the bank note, its color, its pattern, its size, and its paper structure. The designation 6 refers to a drive roller among for example four similar ones and 7 is a press roller among for example four similar ones, with rollers 6 and 7 engaging each other in pairs and cooperating in such manner that only when the whole foremost end of the bank note has moved forward to the point of contact between the drive rollers 6 and the press rollers 7 and the authenticity and denomination of the bank note have been verified by the bank note reader 8 and possible further features have been verified, for example the pattern, size, and paper structure of the bank note, is the bank note fed further to the position illustrated in FIG. 2. It should be noted that the bank note must have reached the nip between all of the drive rollers 6 and all of the press rollers 7 with its entire front edge in order for the bank note to be conveyed further. When the bank note has been conveyed far enough to be located below a seizing and conveying device, which here as an example has the form of a vacuum block 9, the latter is lowered and draws up the bank note by suction with an elongated mouthpiece 9*a* and lifts the bank note to the position shown in FIG. 3. The press rollers 7 are mounted in a plate 10*a* which is connected to a an elongated roller 10 and which is turned up to the position illustrated in FIG. 3 concurrently with the vacuum block making the bank note adhere by suction.

FIG. 4 schematically illustrates the principle of transferring the bank note to a bank note box 11 consisting of an elongated container which is shown in longitudinal section in said figure. Said container has a bottom 12, end walls 13 and 14 and partitions 17, 18, 19, and 20, respectively. Compartments F1, F2, F3, F4, and F5, respectively, are formed between the mentioned walls and partitions and the bottom and are closed at the top by bank note supporting plates 22, 23, 24, 25, and 26, respectively, which are slightly larger than a bank note, said bank note supporting plates being urged from below against edges 27, 28, 29, 30, 31, and 32, respectively, at the upper parts of the walls of said compartments. Tension springs clamped between the bottom and the respective plates 22, 23, 24, 25, and 26, which are located at the top, are positioned in each one of the compartments F1, F2, F3, F4, and F5, respectively, and are designated 22*a*, 23*a*, 24*a*, 25*a*, and 26*a*. Each one of the respective compartments corresponds to one denomination of the bank notes, for example bank notes with the denomination $20 in compartment F1, bank notes with the denomination $50 in compartment F2, bank notes with the denomination $100 in compartment F3, bank notes with the denomination $500 in compartment F4, and bank notes with the denomination $1000 in compartment F5. If desired, the last-mentioned compartment can be made lower, as fewer $1000 bank notes are expected than the number of other bank notes.

As also is shown in the figures mentioned up to now a key 36 is fastened in a key holder 37 and cooperates with a lock 39 in the bank note box 11. The key 36 cannot be removed from the key holder 37 and is only shown schematically so that it may be understood that the locking function is the same as one which would be provided by a key. The key holder 37 is supported by a base plate 38.

The intention is that the bank note box is to have a cover positioned on it when it is pulled out of the bank note handling apparatus and that said cover is to be securely locked at that time by means of lock 39 so that the bank notes will not be accessible from the exterior until the cover is unlocked.

This is more specifically illustrated in FIGS. 5A, 5B, and 5C, respectively. FIG. 5A shows the cover 40 slid onto the bank note box to such extent that the cover nearly has reached bank note compartment F4 and is on its way to its locking position. In FIG. 5B the cover 40 has reached its locking position and has been locked there by the key 36 having been turned by a motor which starts running under the control of a microswitch 69 which cooperates with a projection 68 on the bank note box. The bank note box with the cover slid onto it is then released and can be pulled out of the bank note handling apparatus by means of a handle 70 as illustrated in FIG. 5C so that completely closed and with its contents inaccessible without a key it may be conveyed for example to a safe in the office of the supermarket. In FIGS. 5B and 5C the key 36 has been returned to its initial position in accordance with FIG. 5A after it has been turned.

FIG. 6 shows a perspective view of the bank note handling apparatus viewed from the side for inputting bank notes with the bank note reader not being visible. The dashed lines in the upper portion of the bank note handling apparatus indicate that it is completely enclosed in a casing, but the upper left-hand and right-hand sides of said casing have been removed in said figure so that the interior will be visible. The interior is comprised of the above-mentioned bank note box which in the illustrated position has been slid into the bank note handling apparatus altogether but without the cover being positioned on the bank note box. This positioning does not occur until the bank note box is to be pulled out of the bank note handling apparatus for being conveyed for example to a safe. The front plate of the casing with a slit 4 for inputting and outputting bank notes and the roller 10 are shown in FIG. 6. The vacuum block 9 is also visible and may be displaced upwards and downwards by riding on a rib 56 which is connected to a sidepiece 41 and which is raised and lowered with the latter.

A flexible tube 44 as shown in FIG. 6 has the purpose of ensuring that the vacuum block 9 is subjected to a vacuum and makes it possible for the vacuum block 9 to transverse the entire bank note box in the longitudinal direction of the latter.

FIG. 7 is a perspective view of the bank note handling apparatus corresponding to FIG. 6 but taken from the diagonally opposite position. It may be seen that the earlier mentioned sidepiece 41 can move upwards and downwards on two rotatable screws 45 and 46 having the same threading, said screws being driven by a drive belt 47 which will be mentioned more specifically below. Said screws 45 and 46 are mounted in a mounting plate 48. The opening for introducing the cover which is to be slid onto the bank note box and for permitting withdrawal of the entire enclosed bank note box comprising the cover and the bank note box itself is illustrated at 49.

Figure 8:
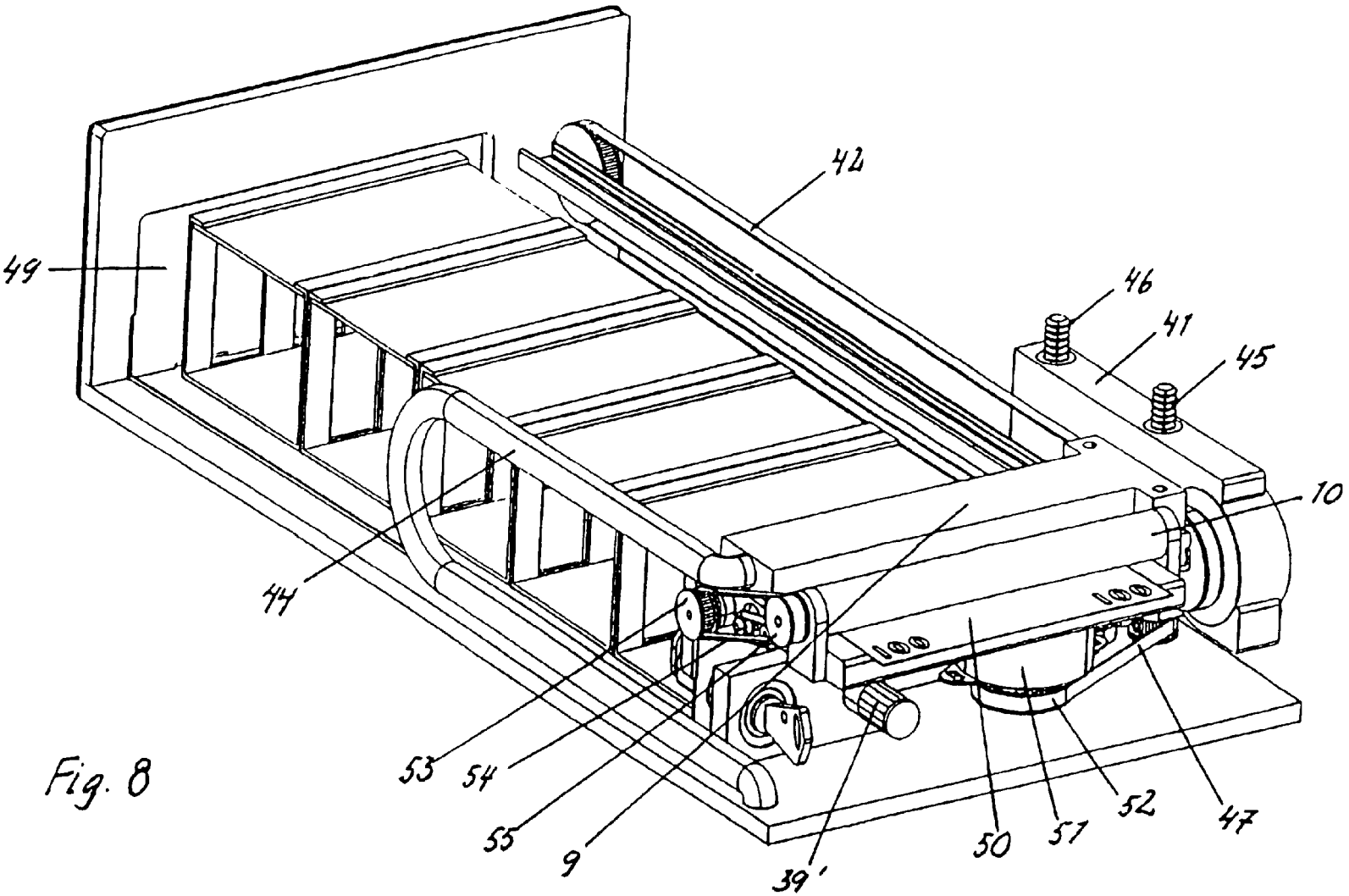
FIG. 8 is a front perspective view of the interior of a preferred embodiment of a bank note handling apparatus according to the present invention without a front plate illustrating a bank note entering the apparatus.

FIG. 8 is another perspective view of the bank note handling apparatus but with the markings showing the exterior of the cover and the front plate with the slit for inputting and outputting bank notes being omitted. FIG. 8 shows a bank note 50 of the denomination "100" which just has been input and is on its way under roller 10. A motor 51 illustrated in this figure makes a belt wheel 52 rotate so that the drive belt 47 (compare FIG. 7) rotates the screws 45 and 46 when vacuum block 9 has attached the bank note thereto by suction and is to convey it to the proper compartment in the bank note box 11. FIG. 8 also shows a drive wheel 53 with associated drive belt 54 which drives roller 10 via a drive wheel 55. The designation 39' refers to the motor for turning the lock key 36 so that the cover is locked onto the bank note box when the cover is fully slid onto the bank note box and the latter is fully positioned in the bank note handling apparatus. When these two requirements are fulfilled the bank note box with the cover fully and firmly locked to it can be pulled out of the bank note handling apparatus.

Figure 9:
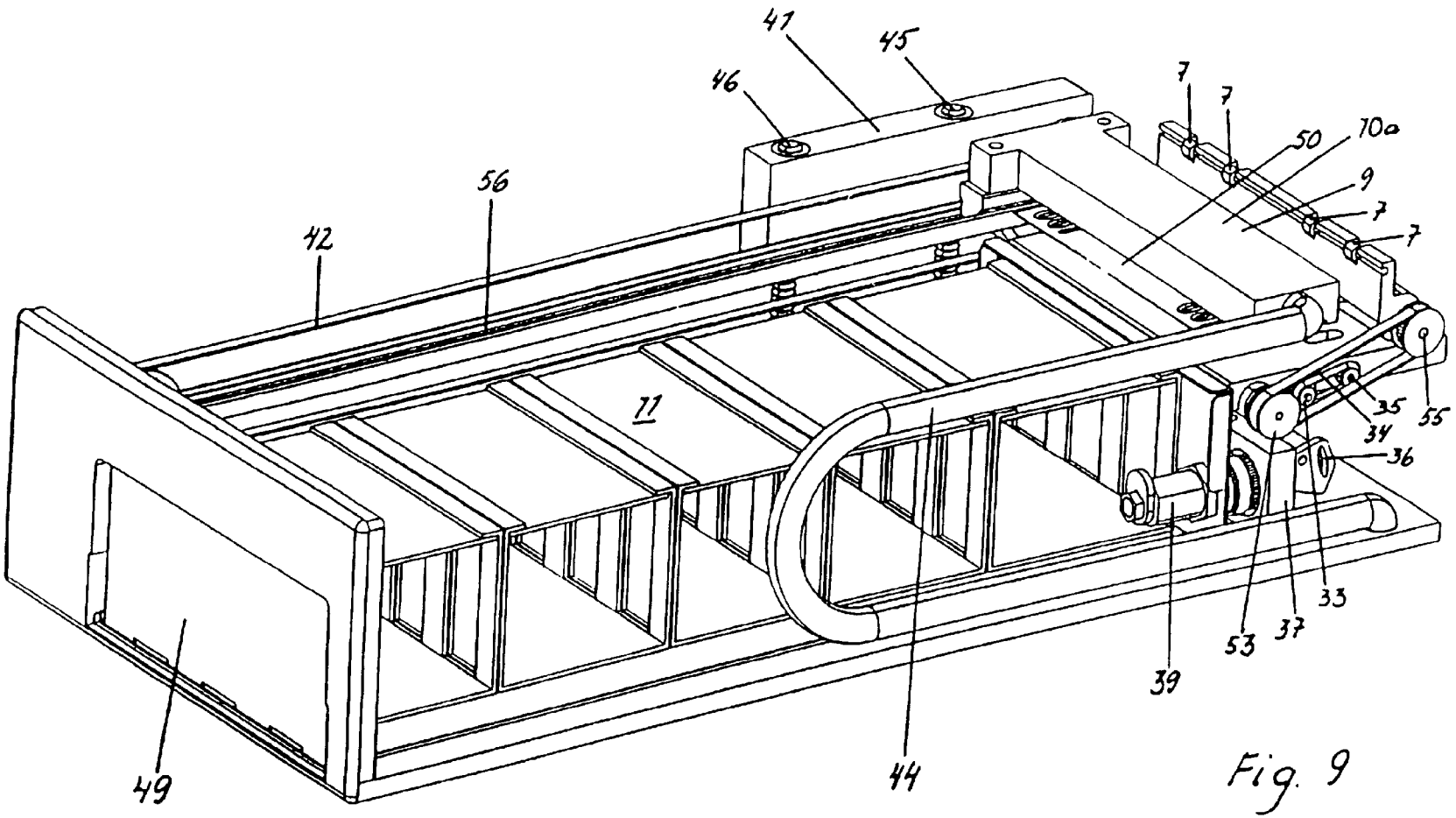

FIG. 9 is a perspective view corresponding to FIG. 8 but in which vacuum block 9 with attached bank note designated "100" has been conveyed upwards on rib 56 along sidepiece 41 by screws 45 and 46 being turned concurrently and in the same direction and the vacuum block is in position to be conveyed over the bank note box 11 and to be lowered into a corresponding bank note compartment. Conveying the vacuum block 9 from the position shown in FIG. 9 to the relevant bank note compartment in the bank note box is carried out by a drive belt 42 pulling said vacuum block which is guided in rib 56. Lock 39 and its associated key 36 are also shown in FIG. 9 as well as wheels 53 and 55 which also may be seen in FIG. 8. The designation 33 in FIG. 9 refers to a drive wheel which via a drive belt 34 drives a drive disc 35 which drives the roller 10 mentioned in connection with FIGS. 1–3 with its rotatable plate 10*a* and the press rollers 7.

Figure 10:
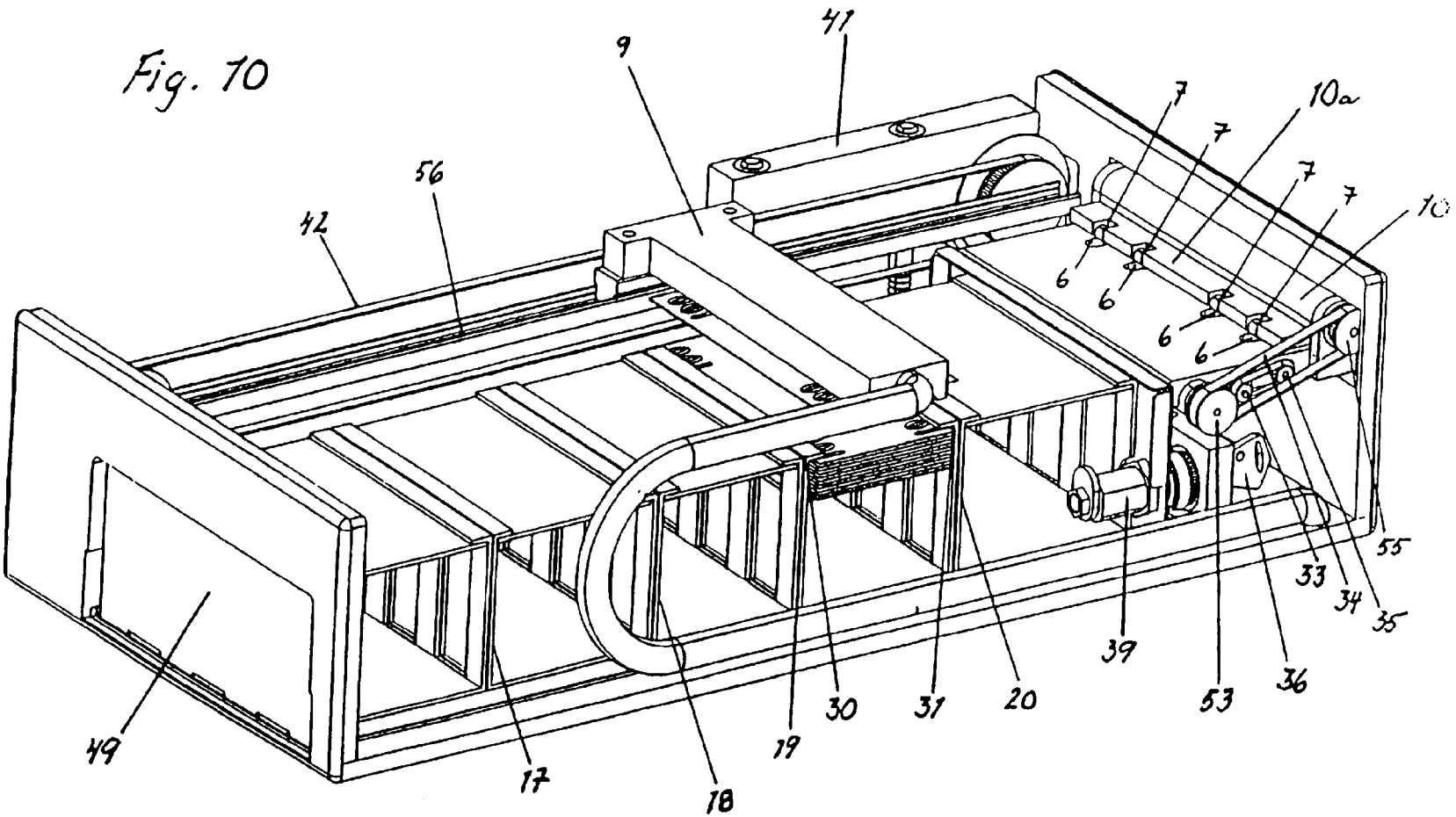
Figure 77:
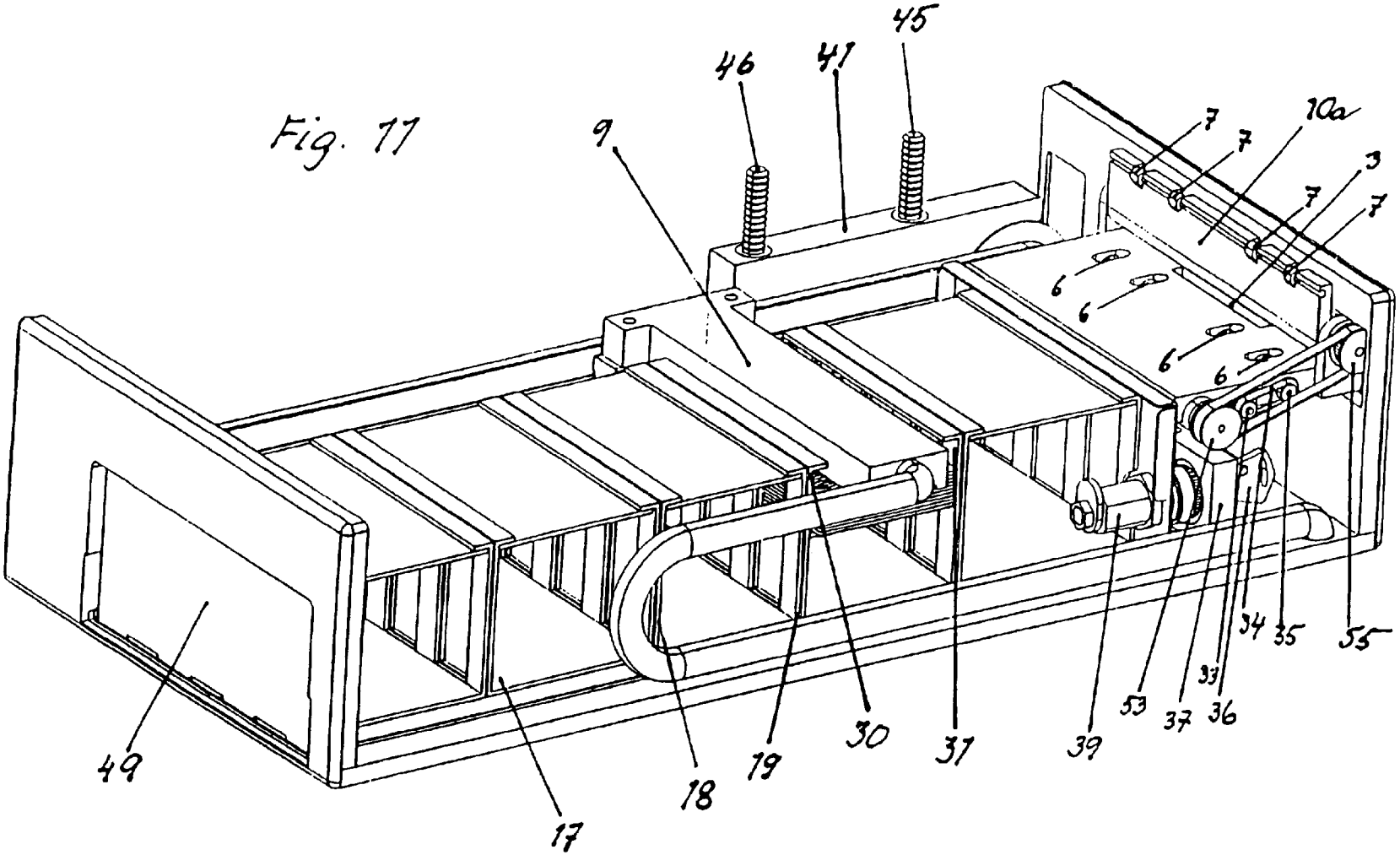

In FIG. 10 the vacuum block 9 has stopped over the bank note compartment into which bank notes with the designation "100" are to be lowered so as to supplement bank notes having the same denominations already lying in the compartment and being retained in the latter by the upper edges 30 and 31. As has been indicated above, bank notes with the denomination "500" would normally have been lowered into this compartment, but for the sake of clarity bank notes having the denominations "100" have been utilized.

FIG. 11 is a perspective view similar to FIG. 10 and shows vacuum block 9 lowered into the bank note compartment for bank notes having the denomination "100". When vacuum block 9 moves upwards again and the vacuum is disconnected, then the bank note which the block has carried will remain in the compartment as it will be retained there by edges 30 and 31.

FIG. 11 also illustrates slit 3 (compare FIGS. 1–3) through which scanning is carried out by the bank note reader for establishing the denomination and authenticity of the bank notes.

Figure 12:
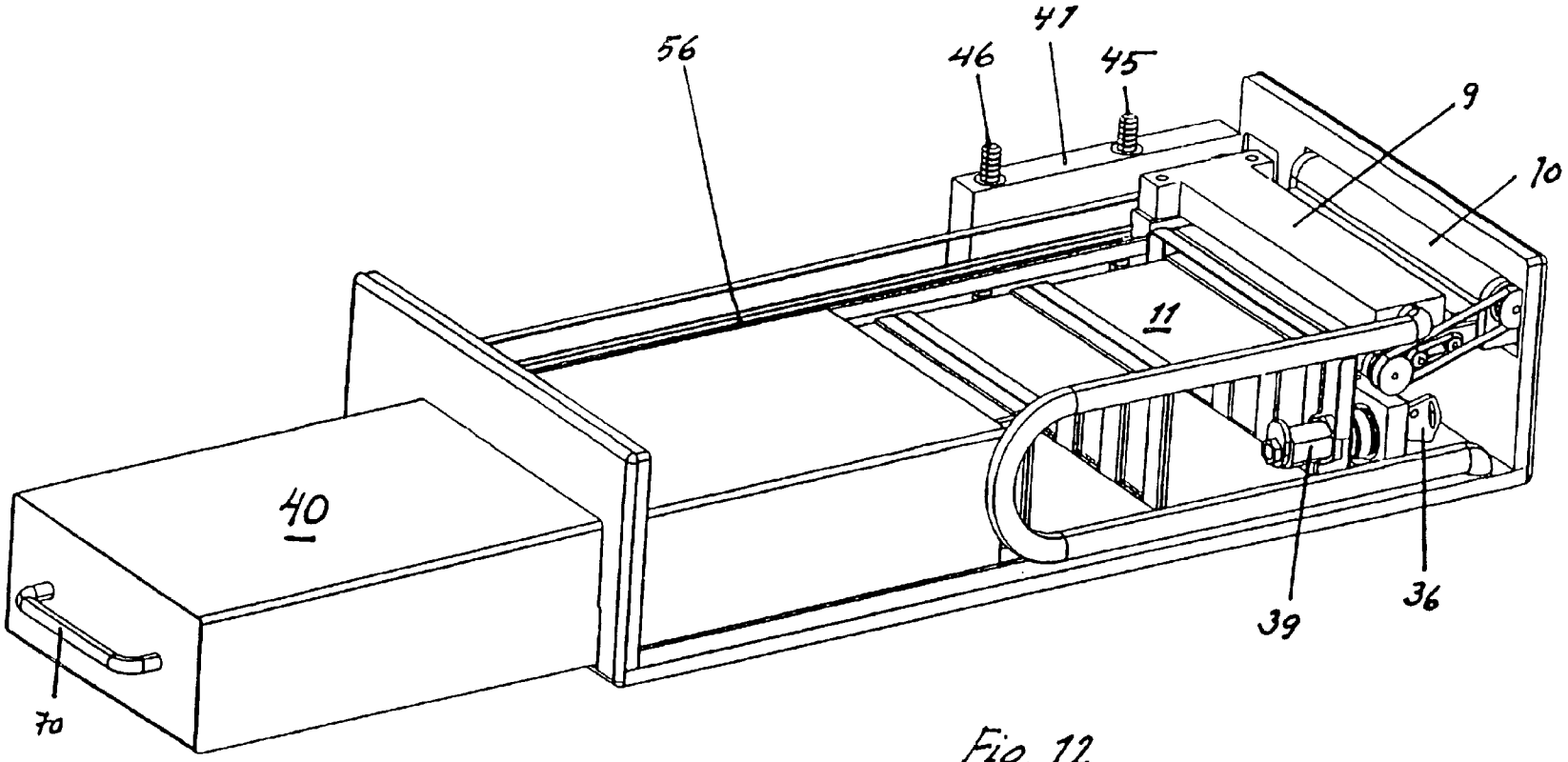
FIG. 12 is a rear perspective view of a preferred embodiment of a bank note handling apparatus according to the present invention illustrating a cover partially positioned on the bank note box.

FIG. 12 is a perspective view of the bank note handling apparatus without its casing and with its cover 40 partially positioned on the bank note box 11 whereas FIG. 13 is a perspective view of the bank note handling apparatus without its casing but with the cover 40 positioned on the bank note box and the latter being pulled out after being released from lock 39 for being carried to a safe or the like by means of handle 70. In this case the bank note box is fully encased and locked and it cannot be unlocked by anyone other than an authorized person whom for example has a key in the office. FIG. 13 also shows the drive mechanism for vacuum block 9 more specifically with the motor 51, drive belt 47, screws 45 and 46, and mounting plate 48 which also are illustrated in earlier figures.

Finally, FIG. 14 illustrates the bank note box when it has been conveyed to the office, wherein a key 71 which is maintained in the office is being prepared to be introduced into the lock so that the contents of the bank note box may be compared to the figures that the cashier has logged in. The projection 68 on the right-hand side of the bank note box cooperates with the earlier mentioned microswitch 69 and comprises an acknowledgement device to ensure that the bank note box is completely locked.

The invention is not limited to the embodiment disclosed above. This merely comprises an example of the invention and its mode of utilization.

What is claimed is:

1. A bank note handling apparatus for respectively receiving and outputting bank notes and for enabling storage of the bank notes under secure circumstances during conveyance, wherein the bank note handling apparatus comprises in combination a common input and output device with a slit (4) for bank notes, a bank note reader (8), a bank note seizing and conveying device (9) cooperating with the bank note reader (8), a bank note box (11) positioned in the bank note handling apparatus and being subdivided into compartments (F1–F5) each for a specific bank note denomination and being adapted to cooperate with said bank note seizing and conveying device (9), a cover (40) which may be slid onto said bank note box (11), a locking device (39) for locking said cover (40) of said bank note box (11), so that the bank note box (11) will be fully enclosed prior to being removed from said bank note handling apparatus, and a key (71) disposed externally of said bank note handling apparatus for unlocking the cover (40) of said bank note box (11).

2. A bank note handling apparatus in accordance with claim 1, wherein each individual bank note compartment (F1–F5) in said bank note box (11) has one or more edges (27–32) positioned at its upper portion, said edges extending over a bank note supporting plate (22, 26) for supporting one or more bank notes, said bank note supporting plate (22–26) being urged in a direction toward said edges (27–32) by a tension spring (22*a*–26*a*) which is clamped between the lower side of said bank note supporting plate (22–26) and the bottom of said bank note compartment (F1–F5).

3. A bank note handling apparatus in accordance with claim 2, said bank note reader (8) being adapted to sense the denomination of the bank note and possible additional features of the bank note, for example the color, pattern, size and paper structure of the bank note, wherein said bank note seizing and conveying device (9) is adapted, when said bank note reader (8) determines the denomination of the bank note and, if desired, approves one or more of said additional features, to seize a bank note, to convey it to above the compartment (F1–F5) in the bank note box which corresponds to the denomination of the bank note, and to output the bank note into said compartment.

4. A bank note handling apparatus in accordance with claim 2, wherein for outputting a bank note from a predetermined bank note compartment (F1–F5) by external activation, for example by actuation of a keypad associated with a computer, the seizing and conveying device (9) is first positioned over said compartment (F1–F5), is then lowered, seizes the bank note, pulls it up out of the compartment (F1–F5) and conveys the seized bank note to the bank note reader (8) which after checking the denomination and possible specific features of the bank note in the computer and approval of the bank note outputs the bank note from the bank note handling apparatus.

5. A bank note handling apparatus in accordance with claim 2, wherein the bank note seizing and conveying apparatus comprises a vacuum suction device (9).

6. A bank note handling apparatus in accordance with claim 1, said bank note reader (8) being adapted to sense the denomination of the bank note and possible additional features of the bank note, for example the color, pattern, size and paper structure of the bank note, wherein said bank note seizing and conveying device (9) is adapted, when said bank reader (8) determines the denomination of the bank note and, if desired, approves one or more of said additional features, to seize a bank note, to convey it to above the compartment (F1–F5) in the bank note box which corresponds to the denomination of the bank note, and to output the bank note into said compartment.

7. A bank note handling apparatus in accordance with claim 6, wherein for outputting a bank note from a predetermined bank note compartment (F1–F5) by external activation, for example by actuation of a keypad associated with a computer, the seizing and conveying device (9) is first positioned over said compartment (F1–F5), is then lowered, seizes the bank note, pulls it up out of the compartment (F1–F5) and conveys the seized bank note to the bank note reader (8) which after checking the denomination and possible specific features of the bank note in the computer and approval of the bank note outputs the bank note from the bank note handling apparatus.

8. A bank note handling apparatus in accordance with claim 6, wherein the bank note seizing and conveying apparatus comprises a vacuum suction device (9).

9. A bank note handling apparatus in accordance with of claim 1, wherein for outputting a bank note from a predetermined bank note compartment (F1–F5) by external activation, for example by actuation of a keypad associated with a computer, the seizing and conveying device (9) is first positioned over said compartment (F1–F5), is then lowered, seizes the bank note, pulls is up out of the compartment (F1–F5) and conveys the seized bank note to the bank note reader (8) which after checking the denomination and possible specific features of the bank note in the computer and approval of the bank note outputs the bank note from the bank note handling apparatus.

10. A bank note handling apparatus in accordance with claim 9 wherein the bank note seizing the conveying apparatus comprises a vacuum suction device (9).

11. A bank note handling apparatus in accordance with of claim 1, wherein the bank note seizing and conveying apparatus comprises a vacuum suction device (9).

12. A bank note handling apparatus in accordance with claim 1, wherein a computer is adapted to sense a predetermined input and output position of the bank note in the bank note reader (8).

13. A bank note handling apparatus in accordance with claim 1, wherein the bank note box (11) contains one or more ink vials which are released and color the bank notes if someone permissibly forces open the cover (40) that is lock onto the bank note box (11).

* * * * *